US005095982A

United States Patent [19]

Peng et al.

[11] Patent Number: 5,095,982

[45] Date of Patent: Mar. 17, 1992

[54] METHOD OF CHARACTERIZING THE FLOWPATH FOR FLUID INJECTED INTO A SUBTERRANEAN FORMATION

[75] Inventors: Chungshiang P. Peng; Pramod K. Singh, both of Tulsa, Okla.

[73] Assignee: Amoco Corporation, Chicago, Ill.

[21] Appl. No.: 694,619

[22] Filed: May 2, 1991

[51] Int. Cl.[5] ..... E21B 47/10; E21B 49/00

[52] U.S. Cl. ..... 166/250; 73/155; 166/252

[58] Field of Search ..... 166/250, 252; 73/155

[56] References Cited

U.S. PATENT DOCUMENTS

| | | | |
|---|---|---|---|
| 3,159,214 | 12/1964 | Carter | 166/252 |
| 3,256,935 | 6/1966 | Nabor et al. | 166/250 X |
| 4,158,957 | 6/1979 | Deans et al. | 166/250 X |
| 4,206,809 | 6/1980 | Jones | 166/252 |
| 4,303,411 | 12/1981 | Chen et al. | 166/252 X |
| 4,458,245 | 7/1984 | Crosnier et al. | 340/853 |
| 4,862,962 | 9/1989 | Prouvost et al. | 73/155 X |

OTHER PUBLICATIONS

Najurieta, H. L.; Robles, O. O.; and Edwards, D. P.; SPE 15636; "Interference Well Testing to Predict Early Water Breakthrough in Naturally fractured Reservoirs" (1986) pp. 1-14.

*Primary Examiner*—George A. Suchfield
*Attorney, Agent, or Firm*—Marcy M. Lyles

[57] ABSTRACT

The flowpath for fluid injected into a hydrocarbon-containing subterranean formation for displacing hydrocarbons through the formation is determined by injecting a fluid into the formation through a wellbore, producing fluids from the formation through the wellbore, and measuring the percentage of injected fluid in produced fluids. A percentage of at least about 90% of injected fluid in produced fluids during production of about the first one-third of the total volume of injected fluid indicates that the primary flowpath is rock matrix.

10 Claims, 7 Drawing Sheets

METHOD OF CHARACTERIZING THE FLOWPATH FOR FLUID INJECTED INTO A SUBTERRANEAN FORMATION

BACKGROUND OF THE INVENTION

1. Field of the Invention

The present invention relates generally to a method of characterizing the flowpath for fluid injected into a subterranean formation for displacing hydrocarbons and, more particularly, to characterizing the flowpath by injecting a fluid into the formation, producing fluids from the formation, and determining the percentage of injected fluid in produced fluids.

2. Setting of the Invention

Production rate of hydrocarbons decreases during primary production due to reduced fluid pressure within a subterranean formation a hydrocarbons are produced from the formation. Recovery of hydrocarbons can be increased by use of a secondary recovery method. Waterflooding is a frequently used secondary recovery method which involves injecting an aqueous fluid such as brine into the subterranean formation for displacing hydrocarbons through the formation toward a production well. A subterranean formation is evaluated before a waterflood is initiated to determine if hydrocarbon recovery will increase sufficiently to justify the cost of waterflooding.

Any increase in recovery of hydrocarbons due to waterflooding is a function of the primary flowpath for fluid injected into a subterranean formation for displacing hydrocarbons. The primary flowpath for fluid injected into a nonfractured formation is rock matrix. Fluid injected into a nonfractured formation primarily flows through hydrocarbon-containing rock matrix of the formation and displaces hydrocarbons. Permeability, porosity, and wettability of the rock matrix affect its capacity for fluid flow. The primary flowpath of a naturally fractured formation is natural fractures unless proper waterflood design causes injected fluid to flow through the hydrocarbon-containing rock matrix. Knowledge of whether the primary flowpath for fluid injected into a subterranean formation is rock matrix or natural fractures is important for properly designing a waterflood.

Available methods for determining if a subterranean formation is naturally fractured are inadequate for characterizing the flowpath for fluid injected into the formation. Core samples can be collected from the near-wellbore region of the subterranean formation and examined for fractures. The core samples are liable to become artificially fractured as they are collected and incorrectly represent subterranean formation natural fractures. Any fractures in the samples may be representative of natural fractures in the near-wellbore region, but not necessarily representative of the flowpath for fluid injected into the formation for displacing hydrocarbons through the formation.

A wellbore wall can be visually examined for fractures by using a borehole televiewer. Again, only the near-wellbore region is examined. Any fractures viewed are not necessarily representative of the flowpath for fluid injected into the formation for displacing hydrocarbons through the formation.

A need exists for a method of characterizing the flowpath for fluid injected into a subterranean formation for displacing hydrocarbons through the formation.

SUMMARY OF THE INVENTION

An object of the present invention is to characterize the flowpath for fluid injected into a hydrocarbon-containing subterranean formation surrounding a wellbore for displacing hydrocarbons through the formation. The object is attained by injecting a fluid capable of displacing hydrocarbons into the subterranean formation through the wellbore at a pressure below the formation fracturing pressure. A volume of the fluid is injected for displacing the hydrocarbons a sufficient distance from the wellbore to allow the flowpath to be characterized. Fluids are produced from the formation through the wellbore and the percentage of injected fluid in produced fluids is measured for determining whether the primary flowpath for fluid injected into the subterranean formation for displacing hydrocarbons through the formation is rock matrix or natural fractures.

A percentage of at least 90% of injected fluid in produced fluids during production of the first one-third of the total volume of injected fluid indicates that the primary flowpath for fluid injected into the subterranean formation for displacing hydrocarbons through the formation is rock matrix.

The characterization of the flowpath is used in properly designing a waterflood to increase recovery of hydrocarbons from the subterranean formation.

DETAILED DESCRIPTION OF THE PREFERRED EMBODIMENT

Figure 1:
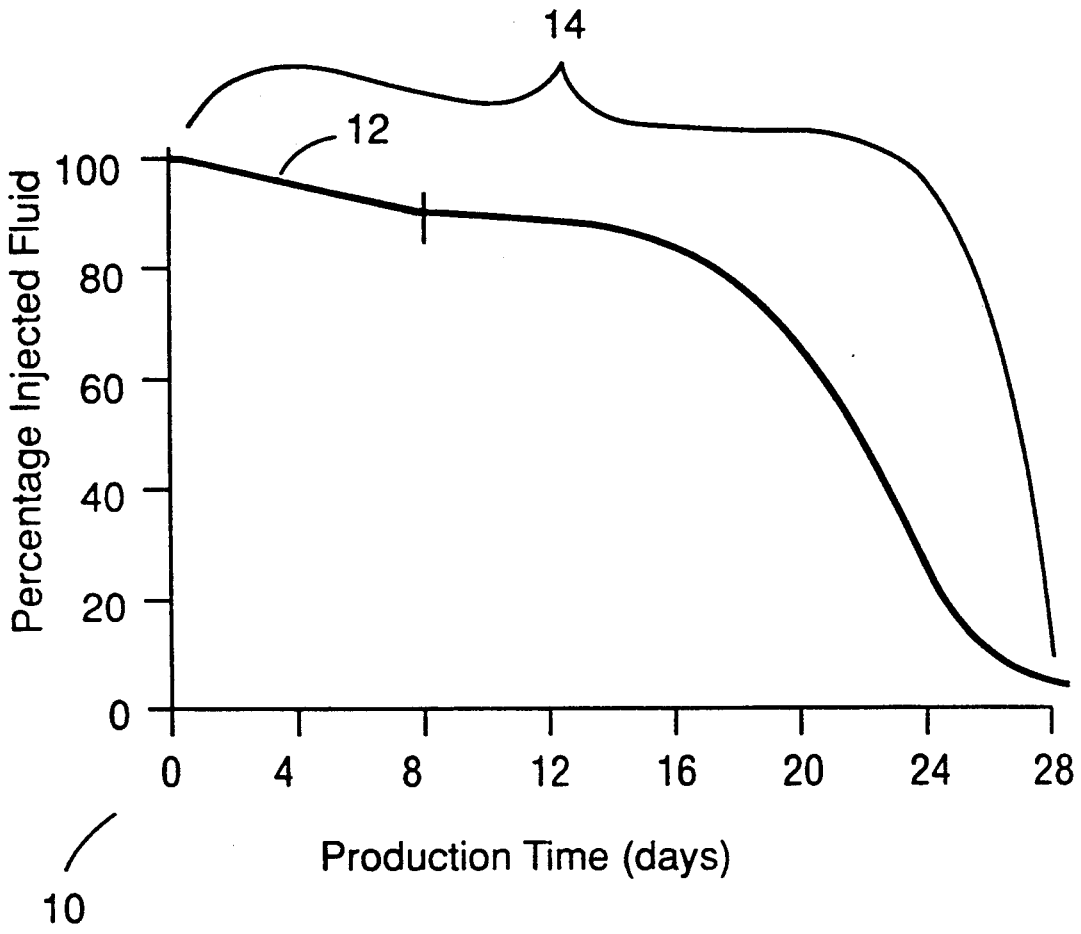
FIG. 1 is a plot of percentage of injected fluid in produced fluids as a function of time for a nonfractured subterranean formation.

An object of the present invention is to characterize the flowpath for fluid injected into a hydrocarbon-containing subterranean formation surrounding a wellbore for displacing hydrocarbons through the formation. The object is attained by injecting a fluid capable of displacing hydrocarbons into the subterranean formation through the wellbore at a pressure below the formation fracturing pressure. A volume of the fluid is injected for displacing the hydrocarbons a sufficient distance from the wellbore to allow the flowpath to be characterized. Fluids are produced from the formation through the wellbore and the percentage of injected fluid in produced fluids is measured for determining whether the primary flowpath for fluid injected into the subterranean formation for displacing hydrocarbons through the formation is rock matrix or natural fractures.

The injected fluid is generally an aqueous fluid which has the capability to displace hydrocarbons and does not chemically interact with the subterranean formation. Aqueous fluids are generally less expensive than other fluids having similar properties. However, other fluids having the required properties can be injected.

A volume of the fluid is injected into the subterranean formation for displacing hydrocarbons a sufficient distance from the wellbore to require about one week to recover about the first one-third of the total volume of injected fluid. This volume is determined using the rate at which fluids will be produced from the formation and an assumption that the primary flowpath for fluid injected into the formation is rock matrix.

The fluid is injected into the subterranean formation by any commercially available injection means, such as by positive displacement or centrifuge pumps. Rate of fluid injection is controlled to maintain wellbore fluid pressure below the formation fracturing pressure so that the formation will not fracture during fluid injection. Formation fracturing pressure may be determined prior to fluid injection by any commercially available method such as the method described in U.S. Pat. No. 4,793,413. Generally, wellbore pressure is maintained at about 50 psi below formation fracturing pressure.

Once the fluid is injected into the formation, injection is shut-in and the injection wellbore is converted to a production wellbore. The wellbore can be shut in for a period to allow near-wellbore pressure to dissipate so that damage to stress-susceptible formations can be avoided at the start of fluid production. A period of one day is thought to be satisfactory.

Fluids are produced from the subterranean formation through the wellbore by any commercially available method, such as by natural flowback or pumping. The percentage of injected fluid in produced fluids is measured during fluid production.

The percentage of injected fluid in produced fluids is indicative of the primary flowpath for a fluid injected into the subterranean formation for displacing hydrocarbons. According to the present invention, a percentage of at least about 90% of injected fluid in produced fluids during production of about the first one-third of the total volume of injected fluid indicates that the primary flowpath for fluid injected into the formation is the rock matrix.

If the primary flowpath for fluid injected into the formation is natural fractures, the percentage of injected fluid in produced fluids during production of about the first one-third of the total volume of injected fluid is substantially less than 90%.

Figure 2:
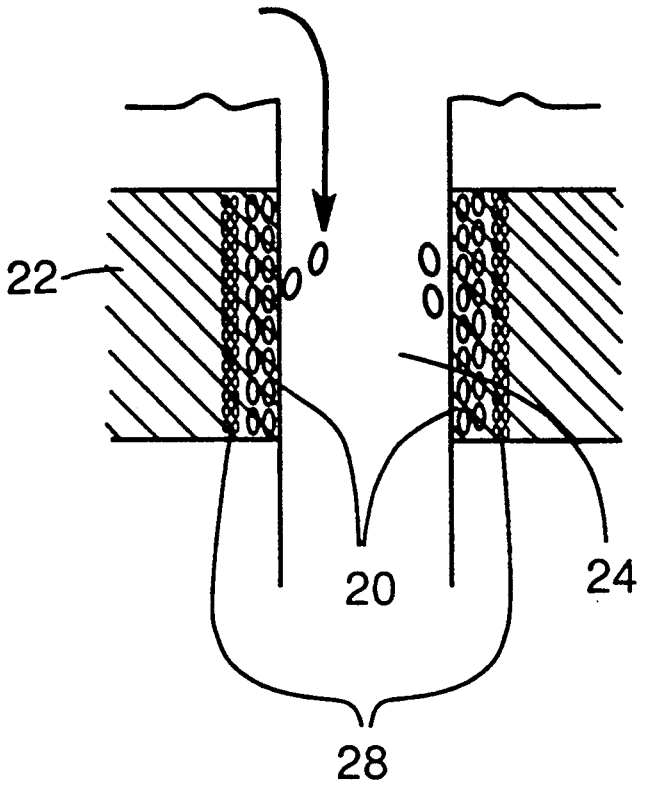
FIG. 2 is a schematic of fluid injection into a nonfractured subterranean formation.
Figure 3:
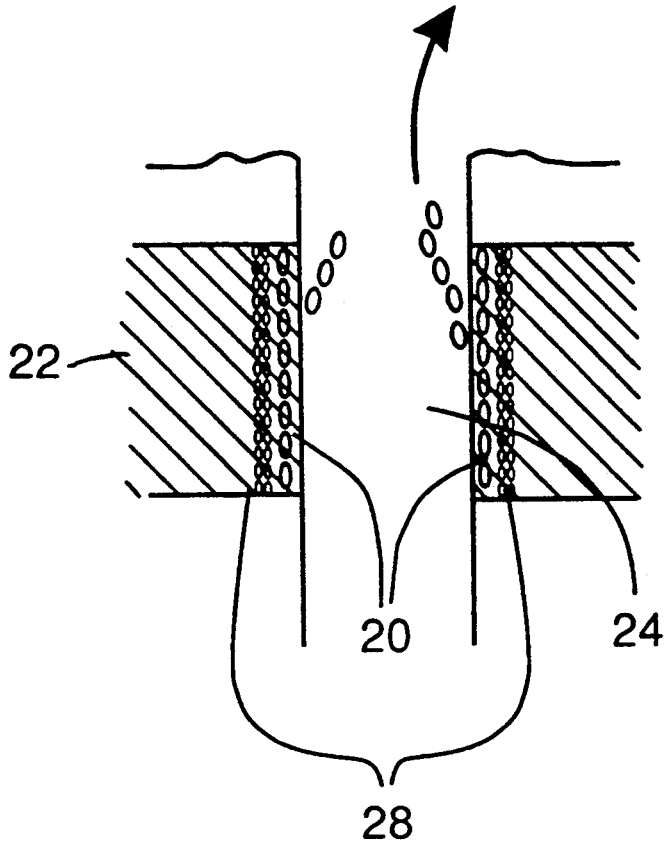
FIG. 3 is a schematic of fluid productior. from a nonfractured subterranean formation.

Fluid production data from a subterranean formation which has rock matrix as its primary flowpath is shown in FIG. 1. Area 12 of curve 14 on plot 10 covers the period during which the first one-third of the total volume of injected fluid is produced. This area is above 90%, indicating that the primary flowpath for fluid injected into the subterranean formation is rock matrix. An explanation for this characterization is illustrated in FIGS. 2 and 3. Injected fluid 20, injected into subterranean formation 22 of FIG. 2 through wellbore 24, displaces hydrocarbons 28 away from the wellbore 24 since subterranean formation 22 has no natural fractures for the injected fluid 20 to flow through. Injected fluid 20 which is accumulated near wellbore 24 of subterranean formation 22 of FIG. 3 is produced prior to hydrocarbons 28. Percentage of injected-fluid 20 in produced fluids is at least about 90% during production of about the first one-third of the total volume of injected fluid.

Figure 4:
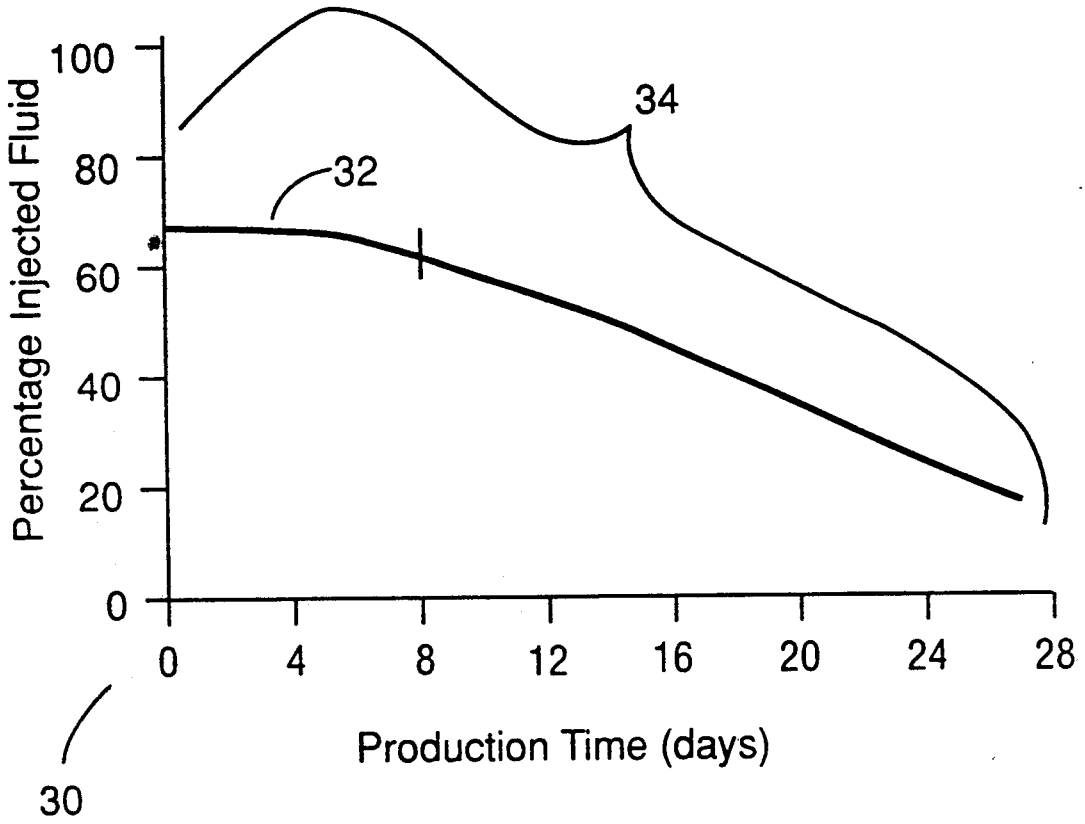
FIG. 4 is a plot of percentage of injected fluid in produced fluids as a function of time for a naturally fractured subterranean formation.
Figure 5:
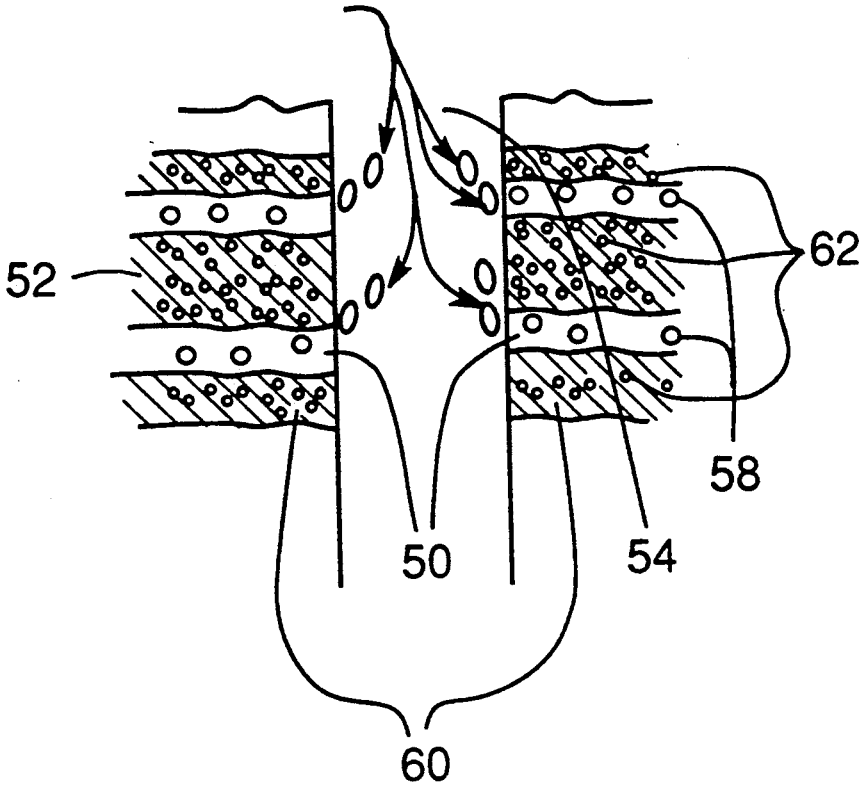
FIG. 5 is a schematic of fluid injection into a naturally fractured subterranean formation.
Figure 6:
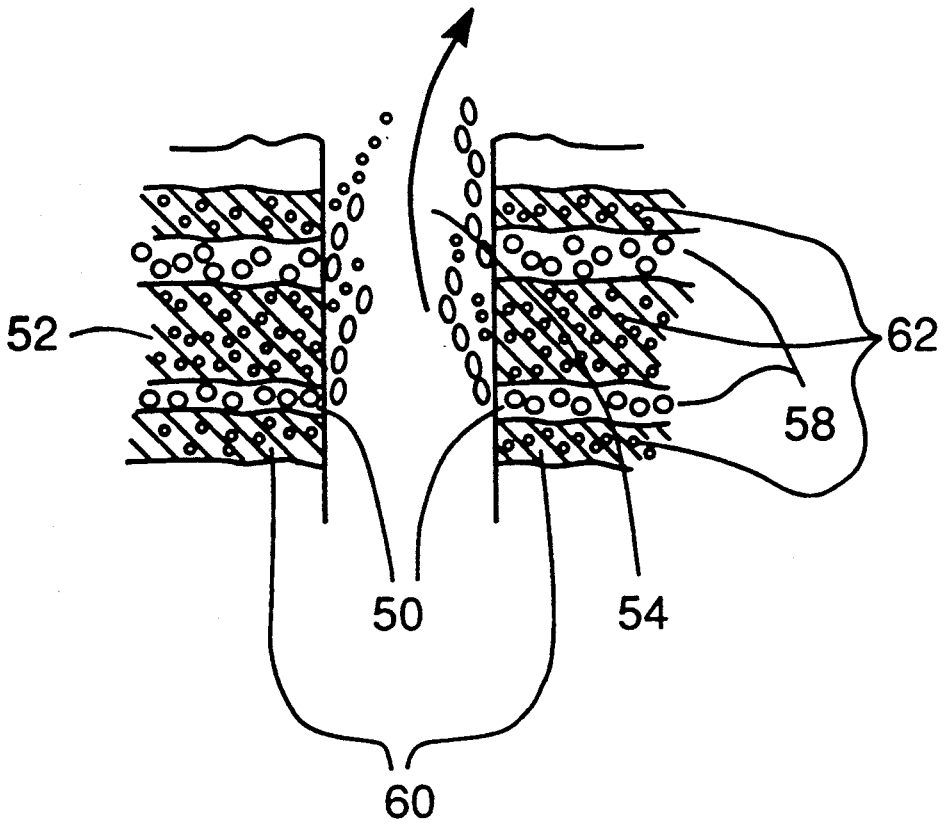
FIG. 6 is a schematic of fluid production from a naturally fractured subterranean formation.

Fluid production data from a naturally fractured subterranean formation is illustrated in FIG. 4. Area 32 of curve 34 on plot 30 is substantially less than 90% during production of the first one-third of the total volume of injected fluid, indicating that the primary flowpath for a fluid injected into the subterranean formation is natural fractures. An explanation for this characterization is illustrated in FIGS. 5 and 6. Injected fluid 50, injected into subterranean formation 52 of FIG. 5 through wellbore 54, flows through natural fractures 58, bypassing hydrocarbons 60 contained in the subterranean formation rock matrix 62. Injected fluid 50, injected into subterranean formation 52 of FIG. 6 through wellbore 54, is produced along with hydrocarbons 60. Percentage of injected-fluid 50 in produced fluids is substantially less than about 90% even at the start of fluid production because hydrocarbons 60 are as likely to be produced as the injected-fluid 50.

Once the flowpath for fluid injected into a subterranean formation for displacing hydrocarbons is characterized, a waterflood can be properly designed.

EXAMPLE

Original volume of hydrocarbons in a subterranean formation under primary depletion is estimated to be about 1.3 billion barrels (0.21 billion $m^3$). Simulation studies show that only about 15% of the original hydrocarbons are recoverable by primary production. A series of single-well tests, including the test of this invention, are performed to obtain information to properly design a waterflood to increase the recovery of hydrocarbons.

A volume of approximately 14,000 barrels (2226 $m^3$) of aqueous fluid, a sufficient volume for characterizing the flowpath for fluid injected into this subterranean formation, is injected into the subterranean formation through a wellbore below the formation fracturing pressure. The injection wellbore is shut-in for 188 hours, for performing a pressure falloff test, and then converted to a production wellbore. Performance of a pressure falloff test is not required for the present invention.

Figure 7:
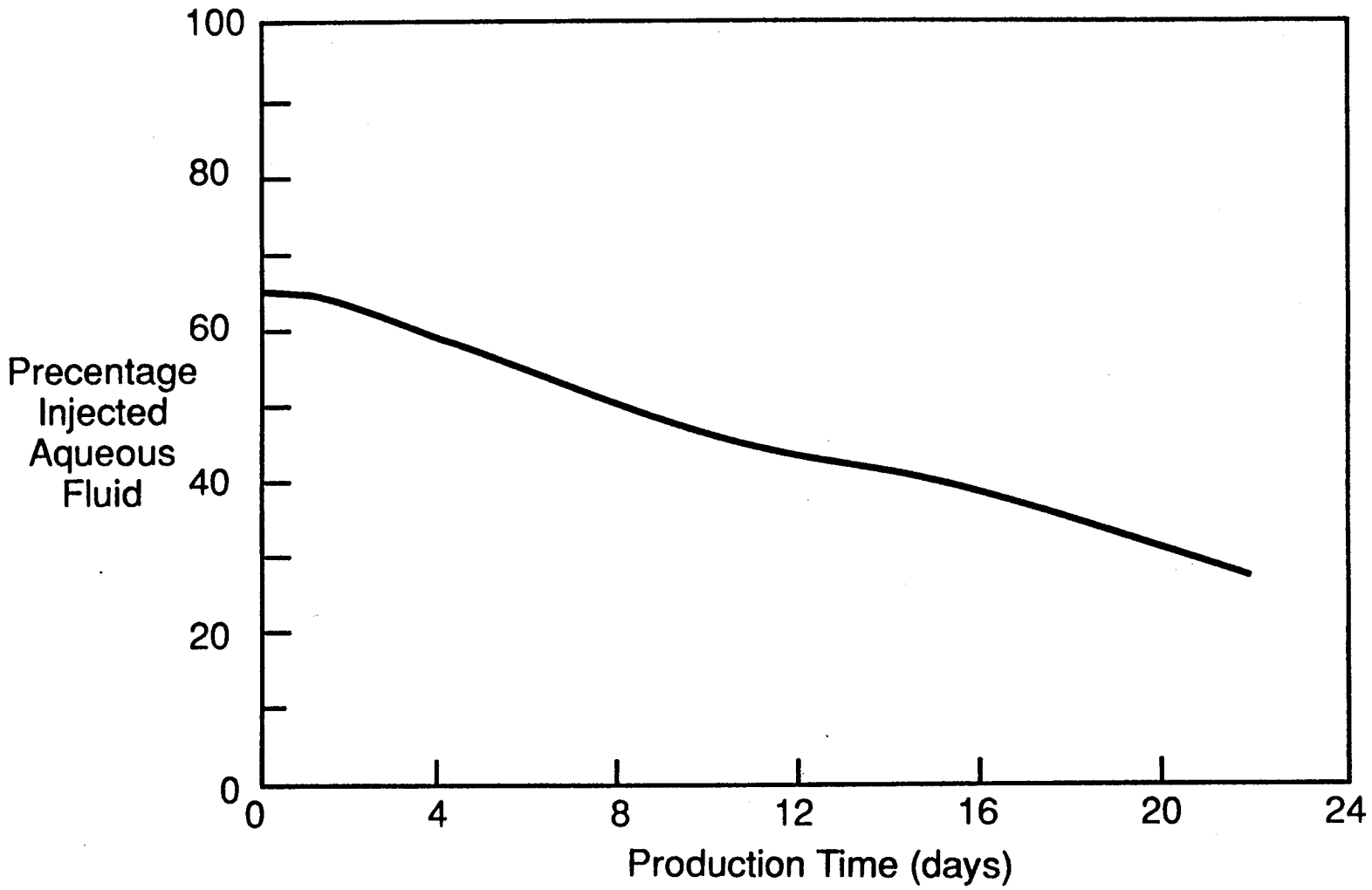
FIG. 7 is a plot of percentage of injected fluid in produced fluids as a function of time for a naturally fractured subterranean formation.

Fluids are produced from the formation through the wellbore for 23 days and percentage of injected aqueous fluid in produced fluids is measured. A plot of percentage injected aqueous fluid in produced fluids as a function of time, FIG. 7, indicates that the percentage reaches a peak of about 70% the first day and steadily declines thereafter. According to the present invention, a percentage of injected fluid in produced fluids of substantially less than about 90% during production of about the first one-third of the total volume of injected fluid, indicates that the primary flowpath for fluid injected into the subterranean formation is natural fractures.

The present invention has been described in particular relation to waterflooding. The information regarding the primary flowpath can be utilized in designing any secondary recovery method, e.g., carbon dioxide flooding or pressure pulsing.

Whereas the present invention has been described in particular relation to the drawings attached hereto and the example herein, it should be understood that other and further modifications, apart from those shown or suggested herein, may be made within the scope and spirit of the present invention.

What is claimed is:

1. A method of characterizing the flowpath for fluid injected into a hydrocarbon-containing subterranean formation surrounding a wellbore for displacing hydrocarbons through the formation, the method comprising the steps:

(a) injecting fluid into the subterranean formation through the wellbore at a pressure below the formation fracturing pressure, wherein the injected fluid is capable of displacing hydrocarbons through the formation and is injected in a volume for displacing the hydrocarbons a sufficient distance from the wellbore to allow the flowpath to be characterized;

(b) producing fluids from the formation through the wellbore; and (c) determining percentage of injected fluid in produced fluids for indicating whether the primary flowpath for fluid injected into the formation for displacing hydrocarbons through the formation is rock matrix or natural fractures.

2. A method according to claim 1, in which a percentage of at least about 90% of injected fluid in produced fluids during production of about the first one-third of the total volume of injected fluid indicates that the primary flowpath for a fluid injected into the subterranean formation is rock matrix.

3. A method according to claim 1, in which a percentage of injected fluid in produced fluids of substantially less than about 90% during production of about the first one-third of the total volume of injected fluid indicates that the primary flowpath for fluid injected into the subterranean formation is natural fractures.

4. A method according to claim 1, in which wellbore pressure during fluid injection is maintained at about 50 psi below formation fracturing pressure.

5. A method according to claim 1, in which the fluid is injected in a volume for displacing hydrocarbons a sufficient distance from the wellbore to ensure that about one week will be required to recover about the first one-third of the total volume of injected fluid.

6. A method according to claim 1, in which the volume for displacing hydrocarbons a sufficient distance from the wellbore to allow the flowpath to be characterized is determined according to an assumption that the primary flowpath for fluid injected into the formation is rock matrix.

7. A method according to claim 1, in which the injected fluid comprises an aqueous fluid.

8. A method of characterizing the flowpath for fluid injected into a hydrocarbon-containing subterranean formation surrounding a wellbore for displacing hydrocarbons through the formation, the method comprising the steps;

(a) injecting an aqueous fluid into the formation through the wellbore at a pressure below the formation fracturing pressure, wherein the aqueous fluid is capable of displacing hydrocarbons through the formation and is injected in a volume for displacing the hydrocarbons a sufficient distance from the wellbore to allow the flowpath to be characterized.

(b) producing fluids from the formation through the wellbore; and (c) determining percentage of injected aqueous fluid in produced fluids for indicating whether the primary flowpath for fluid injected into the formation for displacing hydrocarbons through the formation is rock matrix or natural fractures.

9. A method according to claim 8, in which wellbore pressure during aqueous fluid injection is maintained at about 50 psi below formation fracturing pressure.

10. A method according to claim 8, in which the aqueous fluid is injected in a volume for displacing hydrocarbons a sufficient distance from the wellbore to ensure that about one week will be required to recover about the first one-third of the total volume of injected aqueous fluid.

* * * * *